US007562592B2

(12) United States Patent
Kono et al.

(10) Patent No.: US 7,562,592 B2
(45) Date of Patent: Jul. 21, 2009

(54) MOUNTING STRUCTURE FOR AN AIR-FUEL RATIO SENSOR IN A MOTORCYCLE, AND EXHAUST SUBASSEMBLY INCLUDING SAME

(75) Inventors: Tomoya Kono, Saitama (JP); Takeru Abe, Saitama (JP); Ryutaro Yamazaki, Saitama (JP); Mamoru Uraki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 450 days.

(21) Appl. No.: 11/236,684

(22) Filed: Sep. 27, 2005

(65) Prior Publication Data

US 2006/0065041 A1 Mar. 30, 2006

(30) Foreign Application Priority Data

Sep. 30, 2004 (JP) ..... 2004-286054

(51) Int. Cl.
*G01D 21/00* (2006.01)

(52) U.S. Cl. ..... 73/866.5

(58) Field of Classification Search ..... 73/866.5, 73/117.2, 116, 116.04, 116.09; 60/276; 180/309
See application file for complete search history.

(56) References Cited

U.S. PATENT DOCUMENTS

| | | | | | |
|---|---|---|---|---|---|
| 3,847,778 | A | * | 11/1974 | Riddel | 204/427 |
| 4,000,614 | A | * | 1/1977 | Abthoff et al. | 60/276 |
| 4,553,388 | A | * | 11/1985 | Okubo et al. | 60/276 |
| 5,083,427 | A | * | 1/1992 | Anderson | 60/274 |
| 5,271,477 | A | * | 12/1993 | Gekka et al. | 180/219 |
| 5,271,480 | A | * | 12/1993 | Takegami | 180/309 |

FOREIGN PATENT DOCUMENTS

| | | | | |
|---|---|---|---|---|
| DE | 3721810 | | | 1/1989 |
| DE | 10320247 | | | 11/2003 |
| EP | 0500105 | | | 8/1992 |
| EP | 1055808 | A2 | * | 11/2000 |
| JP | 58152115 | A | * | 9/1983 |
| JP | 59-074360 | | | 4/1984 |
| JP | 59099021 | | | 6/1984 |
| JP | 59110825 | | | 6/1984 |
| JP | 11343895 | | | 12/1999 |
| JP | 11343895 | A | * | 12/1999 |
| JP | 2000-335467 | | | 12/2000 |
| JP | 2001041076 | A | * | 2/2001 |
| JP | 2003327187 | A | * | 11/2003 |

* cited by examiner

*Primary Examiner*—Hezron Williams
*Assistant Examiner*—Tamiko D Bellamy
(74) *Attorney, Agent, or Firm*—Carrier, Blackman & Associates, P.C.; William D. Blackman; Joseph P. Carrier

(57) ABSTRACT

A mounting structure for an air-fuel ratio sensor in a motorcycle is provided which eliminates the influence of water gathered in an exhaust pipe upon the air-fuel ratio sensor and improves the mountability of the air-fuel ratio sensor to the exhaust pipe. The air-fuel ratio sensor is mounted on an exhaust pipe connected to an engine in a motorcycle so that the air-fuel ratio sensor extends radially with respect to a longitudinal axis of the exhaust pipe, and is inclined upward by an angle of 10° or more with respect to a horizontal line H passing through the center of the exhaust pipe 32 in its cross section. The air-fuel ratio sensor is pointed toward the central lateral plane of the motorcycle as viewed in front elevation of the motorcycle.

16 Claims, 5 Drawing Sheets

MOUNTING STRUCTURE FOR AN AIR-FUEL RATIO SENSOR IN A MOTORCYCLE, AND EXHAUST SUBASSEMBLY INCLUDING SAME

CROSS-REFERENCE TO RELATED APPLICATIONS

The present invention claims priority under 35 USC 119 based on Japanese patent application No. 2004-286054, filed on Sep. 30, 2004. The subject matter of this priority document is incorporated by reference herein.

BACKGROUND OF THE INVENTION

1. Field of the Invention

The present invention relates to an air-fuel ratio sensor mounting structure for mounting the sensor to an exhaust system component of a motorcycle, and to an exhaust subassembly incorporating the sensor. More particularly, the present invention relates to a mounting structure for affixing an air-fuel ratio sensor to an exhaust pipe in a motorcycle, and to a related exhaust subassembly including the sensor, the mounting structure, and the exhaust pipe.

2. Background Art

It is well known to employ an oxygen sensor in a motorcycle exhaust system as a control device, so as to improve the catalytic efficiency thereof. In a motorcycle having a multi-cylinder engine, such an oxygen sensor is typically mounted on a manifold of exhaust pipes at a position upstream of a catalytic converter and spaced apart from the engine on the rear lower side thereof. The catalytic converter is used for exhaust purification, for example, and may comprise a three-way catalyst. In a motorcycle having a single-cylinder engine, such an oxygen sensor is located in an empty space, the space selected such that the sensor does not interfere with the engine body. This position improves the maintainability of the sensor and protects the sensor.

Related to this mounting structure, there has been proposed an invention entitled "Air-Fuel Ratio Control Device for Internal Combustion Engine" (Japanese Patent Laid-open No. 59-74360). In Japanese Patent Laid-open No. 59-74360, a catalyst for exhaust purification is provided in an exhaust pipe of an internal combustion engine for a vehicle, and an exhaust gas sensor is mounted upstream of the catalyst. The composition of an exhaust gas to be supplied to the catalyst is detected by the exhaust gas sensor, and the air-fuel ratio of an air-fuel mixture to be taken into the engine is controlled according to a detection signal output from the exhaust gas sensor. According to the description in Japanese Patent Laid-open No. 59-74360, feedback control of such an air-fuel ratio is performed by a known air-fuel ratio control device so that the composition of the exhaust gas is optimized, allowing best purification of the exhaust gas by the catalyst. Further, Japanese Patent Laid-open No. 59-74360 also discloses that an oxygen sensor for detecting the concentration of oxygen in an exhaust gas is generally used as the exhaust gas sensor.

Further, according to the description in an invention entitled "Exhaust Gas Sensor Device in Motorcycle" (Japanese Patent Laid-open No. 2000-335467), an exhaust gas sensor for detecting the concentration of oxygen or the like in an exhaust gas discharged from an engine mounted on a motorcycle may be mounted on an upper wall of an exhaust pipe at a position on the front side of a right projecting portion of a crankcase and on the outer side of a right side surface of a cylinder block.

In both of the references cited above, an oxygen sensor is used as the exhaust gas sensor. This kind of oxygen sensor determines whether the air-fuel ratio is rich or lean with respect to a stoichiometric air-fuel ratio in a narrow region near the stoichiometric air-fuel ratio, but it is not suitable for linear detection of the oxygen concentration over a wide range of values.

Also in a motorcycle, it is desirable to detect the air-fuel ratio in a wide region by using an air-fuel ratio sensor in place of the oxygen sensor mentioned above. In other words, the oxygen sensor merely detects the presence or absence of oxygen in an exhaust gas as mentioned above, whereas the air-fuel ratio sensor can linearly detect the oxygen concentration in an exhaust gas over a wide range by using an element whose output voltage changes in proportion to the oxygen concentration.

Accordingly, the air-fuel ratio sensor is fixed to an exhaust pipe in a motorcycle. However, there is a possibility that water may gather in the exhaust pipe, for example, in driving an engine mounted in the motorcycle. Water gathered in the exhaust pipe may have an adverse effect on the operation of the air-fuel ratio sensor.

Further, it will be necessary to arrange the air-fuel ratio sensor on the exhaust pipe in consideration of a banked operation of the motorcycle, experienced during tight turning thereof. In particular, the air-fuel ratio sensor must be arranged to avoid interference with the surface of the ground when the motorcycle is sharply banked during a turn.

Accordingly, it is an object of the present invention to provide a mounting structure for an air-fuel ratio sensor in a motorcycle which can eliminate the influence of water gathered in the exhaust pipe upon the air-fuel ratio sensor, can eliminate the sensor interference with the surface of the ground during banked operation, and can improve the mountability of the air-fuel ratio sensor to the exhaust pipe, that is, the ease and durability of mounting of the air-fuel ratio sensor.

SUMMARY OF THE INVENTION

According to the present invention, there is provided a mounting structure for an air-fuel ratio sensor in a motorcycle, in which the air-fuel ratio sensor is mounted on an exhaust pipe so as to be pointed upwardly toward the central lateral plane of the motorcycle, as viewed in front elevation of the motorcycle. Preferably, the air-fuel ratio sensor is inclined upward by an angle of 10° or more, with respect to a horizontal line passing through the center of the exhaust pipe in its cross section.

With this arrangement, the concentration of oxygen in an exhaust gas is accurately detected by the air-fuel ratio sensor substantially without being influenced by water gathered in the exhaust pipe, thereby improving detection accuracy. Furthermore, the air-fuel ratio sensor mounted on the exhaust pipe so as to extend upward does not interfere with the surface of the ground, during banked operation of the vehicle. In addition, the air-fuel ratio sensor is easily and firmly mounted on the exhaust pipe, that is, the mountability of the air-fuel ratio sensor is improved.

For a more complete understanding of the present invention, the reader is referred to the following detailed description section, which should be read in conjunction with the accompanying drawings. Throughout the following drawings and description, like numbers refer to like parts. The above-mentioned object, other objects, characteristics and advantages of the present invention will become apparent from the detailed description of the embodiment of the invention presented below in conjunction with the attached drawings.

DETAILED DESCRIPTION OF ILLUSTRATIVE EMBODIMENTS

A selected illustrative embodiment of the mounting structure of the air-fuel ratio sensor in the motorcycle according to the present invention will now be described in some detail, with reference to FIGS. 1 through 5.

Figure 1:
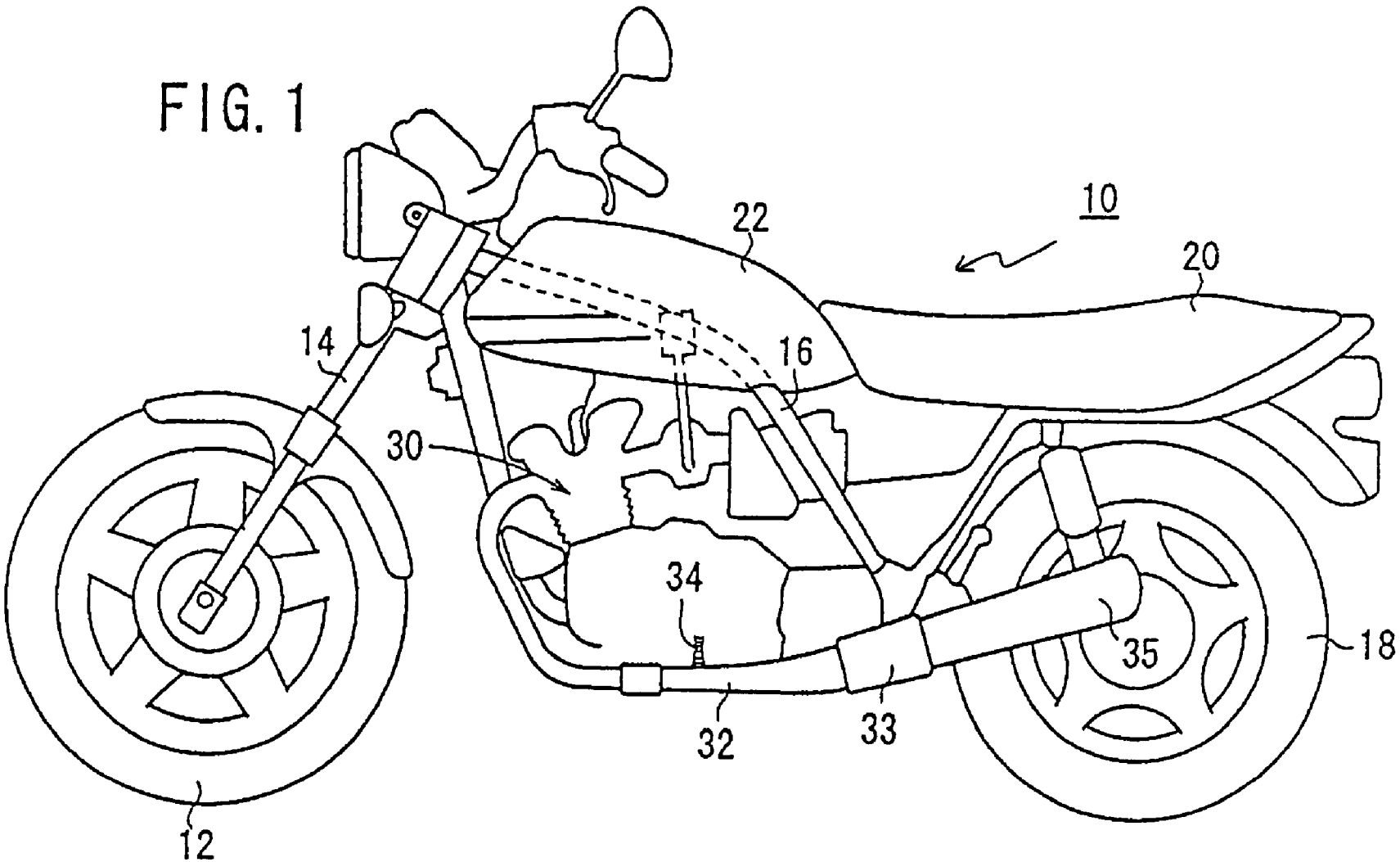
FIG. 1 is a side plan view of a motorcycle including an air-fuel ratio sensor according to a selected illustrative embodiment of the present invention, showing the air-fuel ratio sensor mounted on an exhaust pipe.

FIG. 1 is a simplified side plan view of a motorcycle 10 in which an air-fuel ratio sensor 34, according to a selected illustrative embodiment of the present invention, is mounted on an exhaust pipe 32 thereof. The motorcycle 10 itself has a known structure. More specifically, a front wheel 12 is supported on a front fork 14. The front fork 14 is connected to a frame 16. A rear wheel 18 is provided at a rear portion of the frame 16. A seat 20 is fixed to the frame 16 at a position above the rear wheel 18. A fuel tank 22 is also fixed to the frame 16. A two-cylinder engine 30 is provided below the fuel tank 22. Two exhaust pipes 32 extend, respectively, from the two cylinders of the engine 30 toward the rear side of the vehicle. In FIG. 1, reference numerals 33 and 35 denote a catalytic converter and a muffler, respectively.

Figure 2:
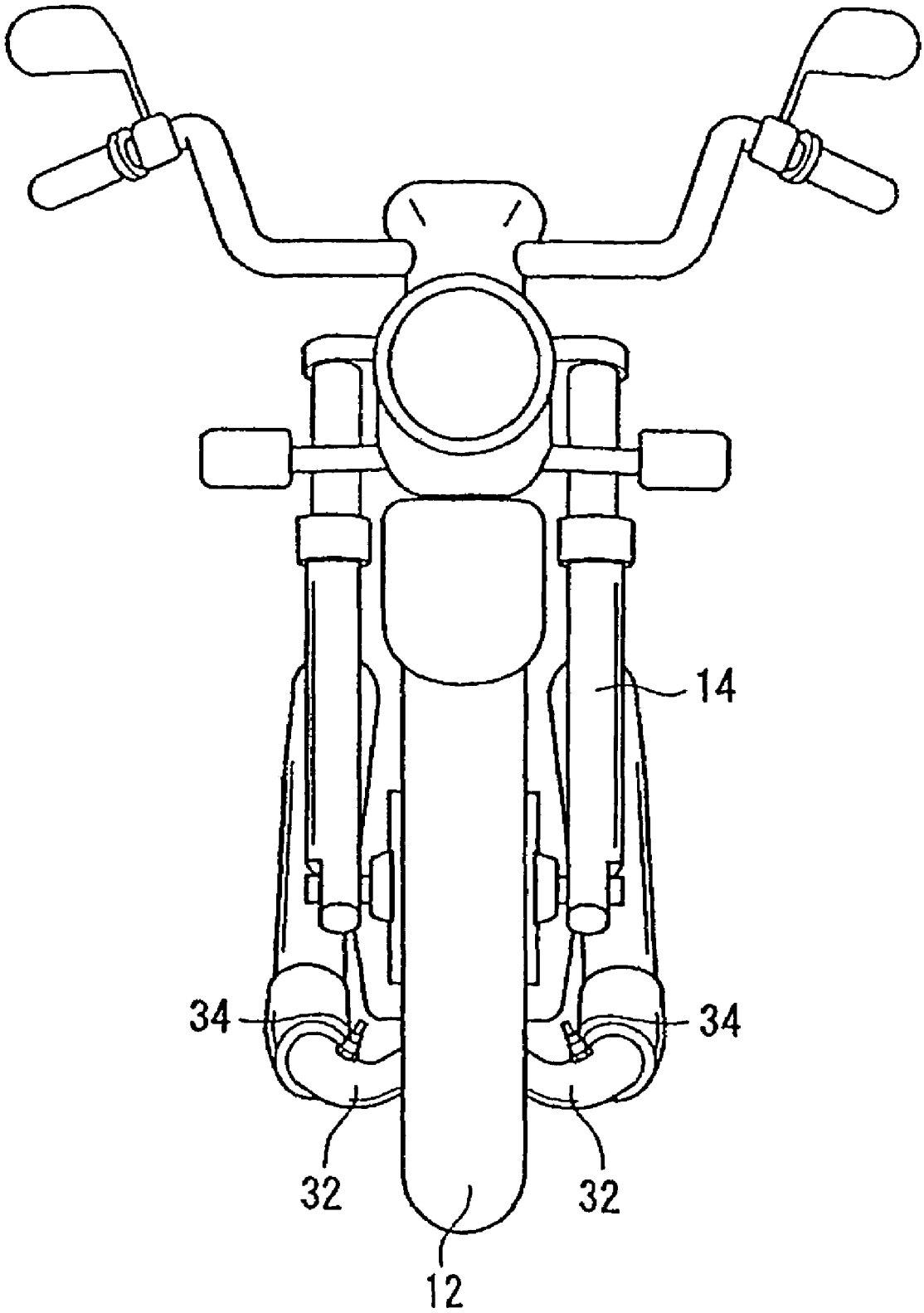
FIG. 2 is a front elevational view of the motorcycle of FIG. 1, showing the air-fuel ratio sensor mounted on an exhaust pipe so as to be angled both upward and laterally inward.

The positional relation between the front wheel 12 and each exhaust pipe 32 is shown in FIG. 2. FIG. 2 is a front elevational view of the motorcycle 10 as viewed from the front side (from the front wheel 12 side) in the longitudinal direction of the motorcycle 10. As viewed in FIG. 2, an air-fuel ratio sensor 34 is mounted on each exhaust pipe 32, respectively, so as to be inclined laterally inwardly toward the front wheel 12, or more specifically, inclined toward the central lateral plane of the motorcycle 10. Additionally, as seen in the side view (FIG. 1), the air-fuel ratio sensor 34 extends generally upwardly, without a forward or rearward inclination. In other words, the air-fuel ratio sensor 34 extends radially with respect to a longitudinal axis of the exhaust pipe 32, with the upper end (the main sensor body 39) of the sensor inclined inwardly in the front view, as shown.

Figure 3:
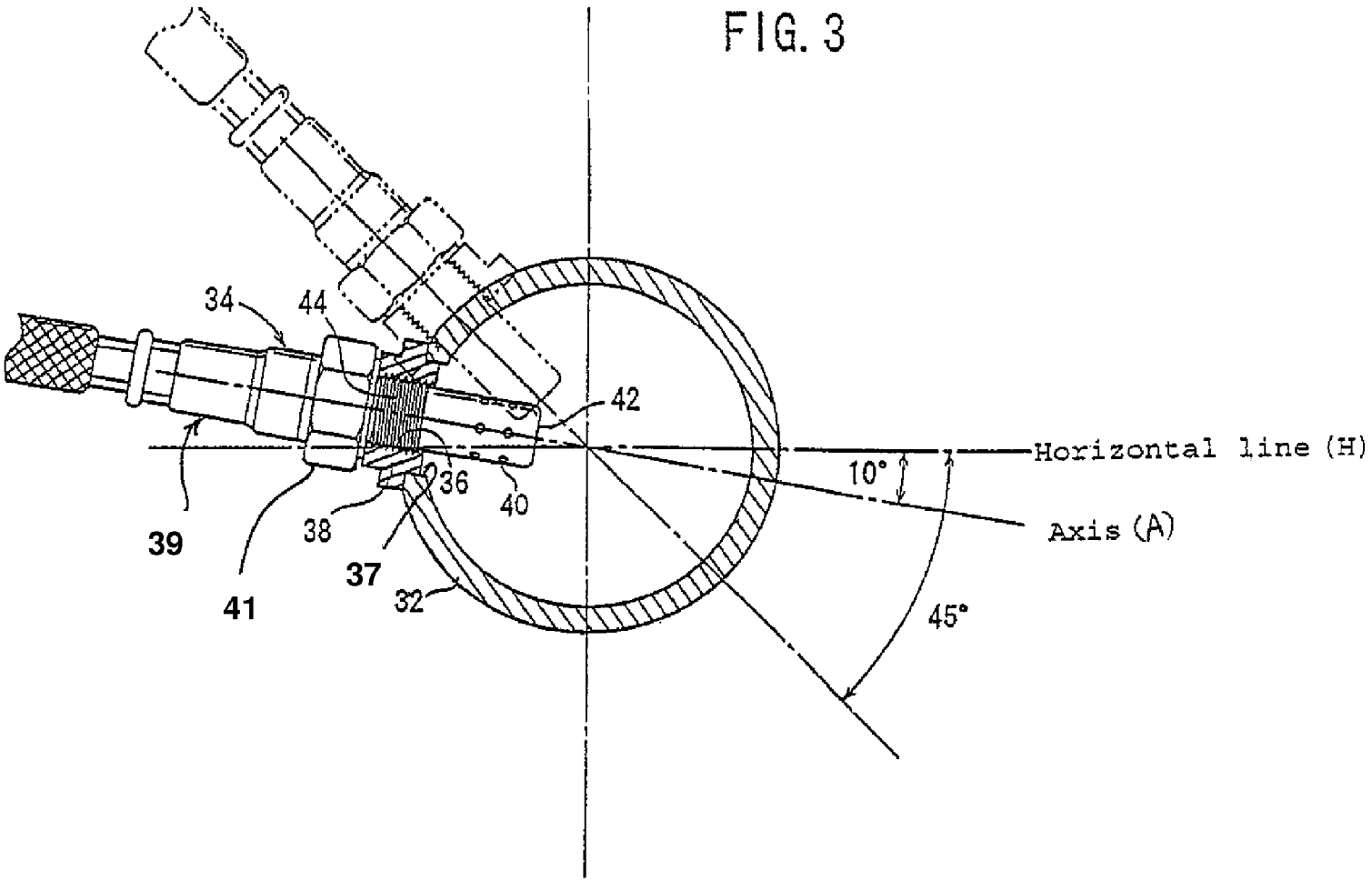
FIG. 3 is a schematic cross sectional view of the exhaust pipe of the motorcycle of FIG. 1, taken at a position where the air-fuel ratio sensor is mounted, and showing a range of possible mounting angles for the sensor.

As shown in FIG. 3, which is a cross sectional view of a representative exhaust pipe 32 at a position where the air-fuel ratio sensor 34 is mounted, each exhaust pipe 32 is formed with a nut 38 affixed thereto in a suitable opening 37 formed to receive the nut. This opening 37 may be threaded internally, if desired, to permit removal and replacement of the nut 38. The nut 38 has a threaded sensor mounting hole 36 formed therein, as shown for receiving and mounting the air-fuel ratio sensor 34. The sensor mounting hole 36 has an axis A inclined toward the upper side of the exhaust pipe 32. More specifically, in the depicted embodiment, the axis A of the sensor mounting hole 36 is inclined upward by an angle of 10° with respect to a horizontal line H passing through the center of the exhaust pipe 32 in its cross section. In an alternative equivalent structure, the nut 38 may be replaced with a reinforced boss (not shown) which is welded on to the exhaust pipe 32, which is integral therewith, and which has threads formed internally therein.

The air-fuel ratio sensor 34 includes a main sensor body 39, which is disposed outside of the exhaust pipe 32 in an installed configuration of the sensor, and a central hexagonal boss portion 41 which is fixedly attached to the main sensor body 39. The hexagonal boss portion 41 enables a mechanic or assembler to grasp the sensor with a tool (not shown) in order to install the sensor in, or remove it from the exhaust pipe 32. The air-fuel ratio sensor 34 also includes a cylindrical end cap 42 formed with a plurality of exhaust gas-introducing holes 40 extending therethrough, as shown. These exhaust gas-introducing holes 40 are composed of two groups spaced apart from each other in the axial direction of the cylindrical end cap 42. The holes 40 within each group are spaced apart from each other in the circumferential direction of the cylindrical end cap 42. A tip portion of the cylindrical end cap 42, having these two groups of holes 40 therein, is disposed within and exposed to the environment on the inside of the exhaust pipe 32. A base portion of the cylindrical end cap 42 is formed with an external thread 44 formed thereon, for engaging an internal thread formed on the inner surface of the nut 38. Accordingly, the air-fuel ratio sensor 34 is fixed to the exhaust pipe 32 by engaging the external thread 44 of the cylindrical end cap 42 of the sensor 34 with the internal thread of the nut 38 fixed to the hole 37 of the exhaust pipe 32. The air-fuel ratio sensor 34 itself could be one of a number of commercially available air-fuel sensors, so the detailed description of the internal structure thereof will be omitted herein.

As will be apparent from FIG. 3, the axis of the air-fuel ratio sensor 34, fixed through the nut 38 to the hole 37 of the exhaust pipe 32, is inclined upward by an angle of 10° with respect to the horizontal line H. This mounting angle of the air-fuel ratio sensor 34 to the exhaust pipe 32 may be set to be greater than 10°, and may be 45° or more (A sensor mounted at an angle of 45° is shown in phantom in the drawing). With this arrangement, the adverse influence of water, which may build up in the exhaust pipe 32, upon the air-fuel ratio sensor 34 is reduced, and the air-fuel ratio sensor 34 is easily mounted.

The holes 40 formed at the tip portion of the cylindrical end cap 42 of the air-fuel ratio sensor 32 are exposed to the ambient environment inside of the exhaust pipe 32, so that exhaust gas in the exhaust pipe 32 is introduced into the cylindrical end cap 42 via the holes 40. The air-fuel ratio sensor 34 thereby detects the concentration of oxygen in the exhaust gas. It is sufficient that at least a part of the holes 40 should be exposed to the environment inside of the exhaust pipe 32, in order to attain the purpose of the air-fuel ratio sensor 34.

Figure 4:
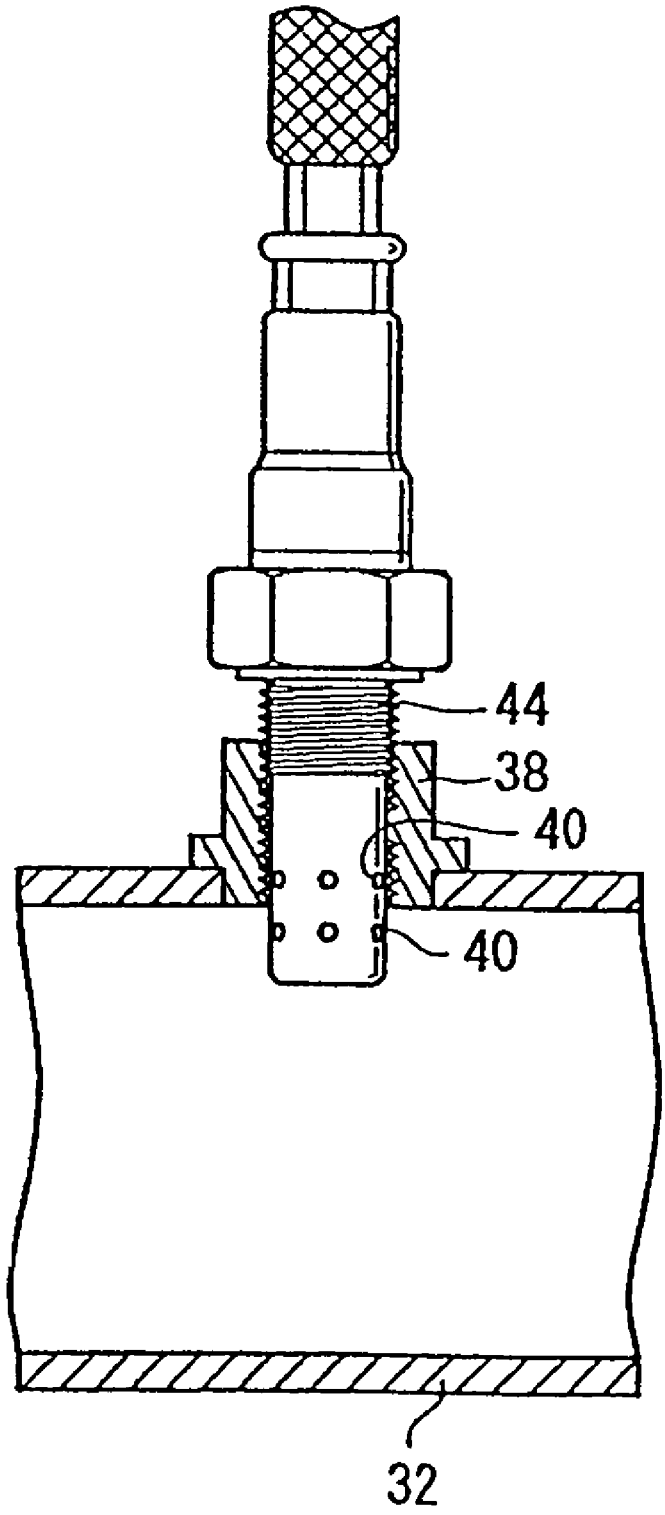
FIG. 4 is a longitudinal sectional view of the exhaust pipe of FIG. 3, showing a modified case where a cylindrical member of the air-fuel ratio sensor is threadedly engaged with the exhaust pipe through a nut.

FIG. 4 shows an example of a configuration in which only one of the two groups of holes 40 located near the front end of the cylindrical end cap 42 is exposed to the environment inside of the exhaust pipe 32, and the other group of holes 40 is retracted inside of the nut 38.

Figure 5:
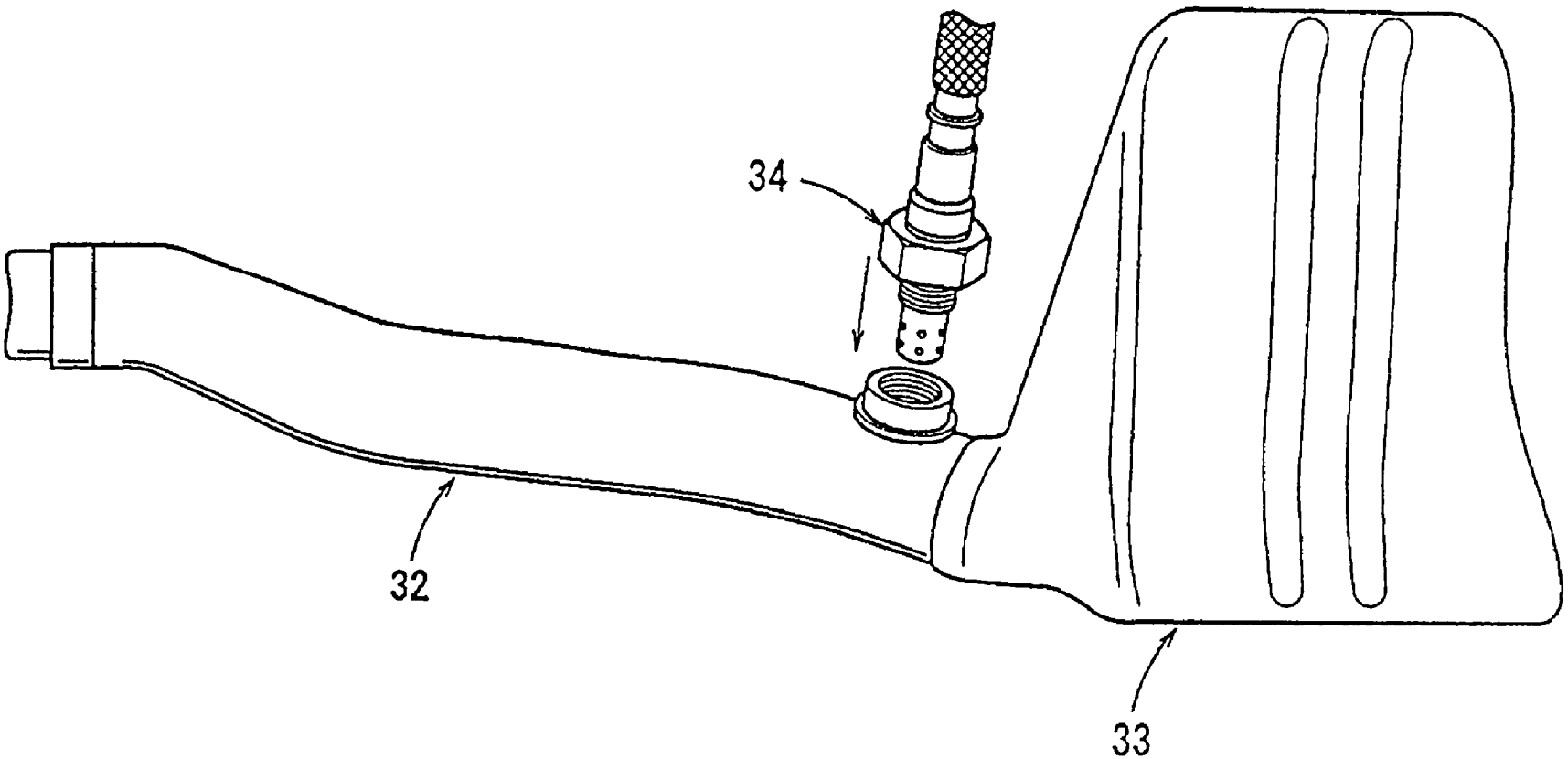
FIG. 5 is a perspective view of the exhaust pipe of FIGS. 3-4, showing a condition where the air-fuel ratio sensor is located immediately upstream of a catalytic converter.

In this case, the air-fuel ratio sensor 34 is preferably located at a position immediately upstream of the corresponding catalytic converter 33, as shown in FIG. 5. Hydrocarbons, carbon monoxide, and nitrogen oxides contained in the exhaust gas are treated by the catalytic converter 33. Accordingly, the oxygen concentration to be detected by the air-fuel ratio sensor 34 is substantially the same as that in the exhaust gas to be introduced into the catalytic converter 33, so that the improvement in accuracy of air-fuel ratio control can be expected.

According to this illustrative embodiment, the air-fuel ratio sensor 34 is mounted on each exhaust pipe 32 of the motorcycle 10 with the main sensor body 39 oriented so as to be inclined upward by an angle of 10° or more with respect to the horizontal line H, passing through the center of the exhaust pipe 32 in its cross section, and be pointed inwardly toward the central lateral plane of the motorcycle 10, as viewed in front elevation of the motorcycle 10 (i.e., as viewed from the vantage point of FIG. 2).

With the arrangement that the air-fuel ratio sensor 34 is inclined upward by an angle of 10° or more as mentioned above, the air-fuel ratio sensor 34 is not significantly influenced by water which may accumulate in the corresponding exhaust pipe 32, so that the oxygen concentration is detected with higher accuracy. Furthermore, since the air-fuel ratio sensor 34 is located above the horizontal line H of the corresponding exhaust pipe 32, the air-fuel ratio sensor 34 is mounted easily and firmly. In addition, even when the motorcycle l is banked during operation, the surface of the ground does not interfere with the air-fuel ratio sensor 34.

Accordingly, the motorcycle 10 is easily driven, and the flexibility of design or layout in the motorcycle 10 is further increased.

While a working example of the present invention has been described above, the present invention is not limited to the working example described above, but various design alterations may be carried out without departing from the present invention as set forth in the claims.

What is claimed is:

1. A mounting structure for an air-fuel ratio sensor in a motorcycle, the motorcycle comprising an exhaust pipe, wherein:

said air-fuel ratio sensor is mounted on an inner side wall portion of the exhaust pipe so as to be pointed upwardly toward a lateral center plane of said motorcycle, as viewed in front elevation of said motorcycle, said inner side wall portion of the exhaust pipe faces towards the lateral center plane of said motorcycle; and a substantial portion of said air-fuel ratio sensor is located above a central horizontal plane bisecting a cross section of said exhaust pipe;

said air-fuel ratio sensor has a central axis which extends substantially radially with respect to a longitudinal axis of the exhaust pipe;

said air-fuel ratio sensor comprises a substantially cylindrical end cap, the end cap comprising a tip portion received within an interior of the exhaust pipe, and a base portion situated adjacent the tip portion, said tip portion has a plurality of gas-receiving holes formed therein, said plurality of gas-receiving holes comprising a first group of gas-receiving holes arranged circumferentially around the tip portion, and a second group of gas-receiving holes arranged circumferentially around the tip portion, wherein the first group of said gas-receiving holes is axially spaced apart from the second group of said gas-receiving holes;

the exhaust pipe has an opening formed therein at said inner side wall portion thereof, and a mounting nut is fixedly attached to the exhaust pipe at said opening, wherein an axial length of the mounting nut is greater than twice the thickness of the exhaust pipe; and wherein said base portion of the air-fuel ratio sensor has male threads formed thereon which are engaged with corresponding female threads formed on an inner surface of the mounting nut for operatively securing said air-fuel ratio sensor on said inner side wall portion of the exhaust pipe.

2. The mounting structure according to claim 1, wherein said central axis of said air-fuel ratio sensor is inclined upwardly by an angle of at least 10° with respect to a horizontal line passing through the center of the cross section of said exhaust pipe.

3. The mounting structure according to claim 1, wherein the first group of gas-receiving holes is positioned within the interior space of the exhaust pipe, and the second group gas-receiving holes is positioned so as to confront the side wall of the exhaust pipe.

4. The mounting structure according to claim 1, wherein the motorcycle further comprises a catalytic converter operatively connected to the exhaust pipe, and wherein said air-fuel ratio sensor is secured to the inner side wall portion of the exhaust pipe immediately adjacent to the catalytic convener at a location upstream from the catalytic converter.

5. A mounting structure for an air-fuel ratio sensor in a motorcycle, the motorcycle comprising an exhaust pipe having an opening formed in an inner side wall portion thereof, and a mounting nut having female threads formed therein fixedly attached to the exhaust pipe at the opening, wherein an axial length of the mounting nut is greater than twice the thickness of the exhaust pipe; and wherein said air-fuel ratio sensor is threadably attached to the mounting nut;

wherein:

said air-fuel ratio sensor includes a substantially cylindrical end cap disposed inside the exhaust pipe, and an external body portion which is integrally attached to the end cap and is disposed outside of the exhaust pipe, the external body portion oriented so as to be pointed upwardly inward toward a lateral center plane of said motorcycle, said air-fuel ratio sensor has a central axis which extends radially in relation to the exhaust pipe so as to extend upwardly and inward toward said lateral center plane of said motorcycle as viewed from the front of the motorcycle;

said inner side wall portion of the exhaust pipe faces towards the lateral center plane of said motorcycle;

a substantial portion of said air-fuel ratio sensor is located above a central horizontal plane bisecting a cross section of said exhaust pipe;

said substantially cylindrical end cap of the air-fuel ratio sensor comprises a tip portion received within an interior of the exhaust pipe, and a base portion situated adjacent the tip portion, the base portion has said male threads formed thereon which are engaged with corresponding said female threads of the mounting nut for operatively securing the air-fuel ratio sensor on the inner side wall portion of the exhaust pipe; and wherein the tip portion has a plurality of gas-receiving holes formed therein, said plurality of gas-receiving holes comprising a first group of gas-receiving holes arranged circumferentially around the tip portion, and a second group of gas-receiving holes arranged circumferentially round the tip portion, wherein the first group of the gas-receiving holes is axially spaced apart from the second group of the gas-receiving holes.

6. The mounting structure according to claim 5, wherein said air-fuel ratio sensor is inclined upward by an angle in a range of 10° to 45° with respect to a horizontal line passing through the center of the cross section of said exhaust pipe.

7. The mounting structure according to claim 5, wherein the motorcycle further comprises a catalytic converter operatively connected to the exhaust pipe, and wherein said air-fuel ratio sensor is secured to inner side wall portion of the exhaust pipe immediately adjacent to the catalytic converter at a location upstream from the catalytic converter.

8. An exhaust subassembly for use on a motorcycle, the subassembly comprising:

an exhaust pipe having an inner side wall with a hole formed therein;

a reinforcing member attached to the inner side wall of the exhaust pipe, the reinforcing member comprising a cylindrical collar with a threaded hole formed therein; wherein an axial length of the reinforcing member is greater than twice the thickness of the exhaust pipe; and an air-fuel ratio sensor comprising:

a main sensor body disposed outside of the exhaust pipe above a central horizontal plane bisecting a cross section of said exhaust pipe;

a hexagonal boss integrally attached to the main sensor body; and a substantially cylindrical end cap with male threads formed thereon which fit in the threaded hole of the cylindrical collar, the end cap being integrally attached to the main sensor body;

wherein said air-fuel ratio sensor is mounted on the exhaust pipe with the main sensor body oriented so as to be pointed upwardly inward toward a lateral center plane of said motorcycle, as viewed in front elevation of said motorcycle, in an installed configuration of said subassembly; and wherein:

said inner side wall of the exhaust pipe faces towards the lateral center plane of said motorcycle;

said substantially cylindrical end cap of the air-fuel ratio sensor comprises a tip portion received within an interior of the exhaust pipe, and a base portion situated adjacent the tip portion, the base portion having said male threads formed thereon corresponding to threads of said threaded hole of the cylindrical collar for operatively securing the air-fuel ratio sensor on the side wall of the exhaust pipe, and the tip portion has a plurality of gas-receiving holes formed therein; said plurality of gas-receiving holes comprising a first group of gas-receiving holes arranged circumferentially around the tip portion, and a second group of gas-receiving holes arranged circumferentially around the tip portion, wherein the first group of said gas-receiving holes is axially spaced apart from the second group of the gas receiving holes.

9. The exhaust subassembly according to claim 8, wherein said air-fuel ratio sensor has a central axis which is inclined upward by an angle of at least 10° with respect to a horizontal line passing through the center of the cross section of said exhaust pipe.

10. The exhaust subassembly according to claim 8, wherein said air-fuel ratio sensor has a central axis which extends substantially radially with respect to a longitudinal axis of the exhaust pipe.

11. The exhaust subassembly according to claim 8, wherein the first group said gas-receiving holes is positioned within the interior space of the exhaust pipe, and the second group of said gas-receiving holes is positioned so as to confront the inner side wall of the exhaust pipe.

12. The exhaust subassembly according to claim 8, wherein the exhaust subassembly further comprises a catalytic converter operatively connected to the exhaust pipe, and wherein said air-fuel ratio sensor is secured to inner side wall of the exhaust pipe immediately adjacent to the catalytic converter at a location upstream from the catalytic converter.

13. An exhaust subassembly for use on a motorcycle, the subassembly comprising:

an exhaust pipe having an inner side wall with a hole formed therein;

a reinforcing member attached to the inner side wall of the exhaust pipe, the reinforcing member comprising a cylindrical collar with a threaded hole formed therein; wherein an axial length of the cylindrical collar is greater than twice the thickness of the exhaust pipe; and an air-fuel ratio sensor having a substantially cylindrical end cap with male threads formed thereon which fit in the threaded hole of the cylindrical collar;

wherein:

said inner side wall of the exhaust pipe faces towards a lateral center plane of said motorcycle;

wherein said air-fuel ratio sensor has a central axis which extends radially in relation to the exhaust pipe so as to extend upward and inward toward the lateral center plane of said motorcycle as viewed from the front of the motorcycle, in an installed configuration of said subassembly; and a substantial portion of said air-fuel ratio sensor is located above a central horizontal plane bisecting a cross section of said exhaust pipe, said substantially cylindrical end cap of the air-fuel ratio sensor comprises a tip portion received within an interior of the exhaust pipe, and a base portion situated adjacent the tip portion, said based portion having said male threads formed thereon corresponding to threads of said threaded hole of the cylindrical collar for operatively securing the air-fuel ratio sensor on the exhaust pipe; and the tip portion has a plurality of gas-receiving holes formed therein, said plurality of gas-receiving holes comprising a first group of gas-receiving holes arranged circumferentially around tip portion, and a second group of gas-receiving holes arranged circumferentially around the tip portion; and wherein the first group of said gas-receiving holes is axially spaced apart from the second group of the gas receiving holes.

14. The exhaust subassembly according to claim 13, wherein said air-fuel ratio sensor is inclined upward by an angle in a range of 10° to 45° with respect to a horizontal line passing through the center of a cross section of said exhaust pipe.

15. The exhaust subassembly according to claim 13, wherein the motorcycle further comprises a catalytic converter operatively connected to the exhaust pipe, and wherein said air-fuel ratio sensor is secured to the inner side wall of the exhaust pipe immediately adjacent to the catalytic converter at a location upstream from the catalytic converter.

16. The mounting structure of claim 1, wherein the mounting nut comprises a cylindrical collar with said threaded hole formed therein; said mounting nut adapted to reinforce said exhaust pipe around said opening;

wherein the air-fuel ratio sensor comprises:

a main sensor body disposed outside of the exhaust pipe; and a hexagonal boss integrally attached to the main sensor body; and, wherein the substantially cylindrical end cap is integrally attached to the main sensor body; and wherein the air-fuel ratio sensor is mounted on the exhaust pipe with the main sensor body oriented so as to be pointed upwardly inward toward the lateral center plane of the motorcycle, as viewed from the front the motorcycle.

* * * * *